US009534384B2

(12) United States Patent
Homenko et al.

(10) Patent No.: US 9,534,384 B2
(45) Date of Patent: Jan. 3, 2017

(54) CONCRETE AND INSULATION COMPOSITE STRUCTURAL BUILDING PANELS INCLUDING ANGLED SHEAR CONNECTORS

(71) Applicants: Keith N. Homenko, Winnipeg (CA); Lawrence N. Homenko, Winnipeg (CA)

(72) Inventors: Keith N. Homenko, Winnipeg (CA); Lawrence N. Homenko, Winnipeg (CA)

( * ) Notice: Subject to any disclaimer, the term of this patent is extended or adjusted under 35 U.S.C. 154(b) by 0 days.

(21) Appl. No.: 14/671,419

(22) Filed: Mar. 27, 2015

(65) Prior Publication Data

US 2016/0281358 A1 Sep. 29, 2016

(51) Int. Cl.

| | |
|---|---|
| ***E04C 2/288*** | (2006.01) |
| ***E04C 2/04*** | (2006.01) |
| ***B28B 1/16*** | (2006.01) |

(52) U.S. Cl.

CPC ..... *E04C 2/2885* (2013.01); *B28B 1/16* (2013.01); *E04C 2/044* (2013.01); *E04C 2002/047* (2013.01)

(58) Field of Classification Search

CPC ..... E04C 2002/045; E04C 2/205; E04C 1/40; E04C 1/41; E04C 2/288; E04C 2/049; E04C 5/064; E04C 2/2885; E04C 5/20

USPC ..... 52/309.12, 309.17, 334, 405.3, 405.4,52/410, 426, 418

See application file for complete search history.

(56) References Cited

U.S. PATENT DOCUMENTS

| | | | | | |
|---|---|---|---|---|---|
| 4,079,560 | A * | 3/1978 | Weismann | B21F 27/128 | 52/309.12 |
| 4,698,947 | A * | 10/1987 | McKay | E04B 2/8641 | 52/309.11 |
| 4,974,381 | A | 12/1990 | Marks | | |
| 5,107,648 | A * | 4/1992 | Roby | E04B 2/8647 | 52/309.12 |
| 5,440,845 | A * | 8/1995 | Tadros | E04C 2/044 | 52/309.12 |
| 5,673,525 | A * | 10/1997 | Keith | B28B 19/003 | 411/487 |
| 6,088,985 | A * | 7/2000 | Clark | E04C 2/044 | 52/309.11 |
| 6,226,942 | B1 * | 5/2001 | Bonin | E04B 5/04 | 52/309.11 |
| 6,272,805 | B1 * | 8/2001 | Ritter | E04C 2/044 | 52/309.11 |
| 6,276,104 | B1 * | 8/2001 | Long, Sr. | B29C 44/569 | 428/318.4 |
| 8,555,584 | B2 * | 10/2013 | Ciuperca | E04B 1/355 | 52/309.12 |
| 8,756,890 | B2 * | 6/2014 | Ciuperca | E04B 1/21 | 249/190 |

(Continued)

*Primary Examiner* — Brian Glessner
*Assistant Examiner* — Adam Barlow
(74) *Attorney, Agent, or Firm* — Ryan W. Dupuis; Kyle R. Soutterthwaite; Ade & Comany Inc.

(57) ABSTRACT

A composite structural building panel has a first concrete layer and a second concrete layer in spaced apart relationship with one another so as to receive an insulation layer spanning between the first concrete layer and the second concrete layer. A plurality of shear connectors are individually supported to extend through respective bores in the insulation layer between opposing first and second ends of the shear connector which are entirely embedded in the first and second concrete layers respectively. At least some of the shear connectors are oriented at an inclination to a normal axis of the insulating layer.

15 Claims, 2 Drawing Sheets

(56) References Cited

U.S. PATENT DOCUMENTS

| | | | | |
|---|---|---|---|---|
| 9,145,695 | B2 * | 9/2015 | Ciuperca | B23P 11/00 |
| 2004/0065034 | A1 * | 4/2004 | Messenger | E04C 2/044<br>52/309.11 |
| 2005/0284088 | A1 * | 12/2005 | Heath | E04B 2/845<br>52/741.1 |
| 2008/0155919 | A1 * | 7/2008 | Keshishian | E04C 2/044<br>52/309.11 |
| 2011/0131892 | A1 * | 6/2011 | Del Pino | B28B 19/00<br>52/125.4 |

* cited by examiner

CONCRETE AND INSULATION COMPOSITE STRUCTURAL BUILDING PANELS INCLUDING ANGLED SHEAR CONNECTORS

FIELD OF THE INVENTION

The present invention relates to non-conducting connector rods inserted within a precast sandwich wall panel formed of two structural concrete wythes separated completely by a layer of insulation between the concrete wythes.

BACKGROUND

Precast concrete panels are well established within the art and offer many advantages for building construction which will not be discussed here. The most notable drawback of this building system is the large thermal mass of the concrete exposed to the ambient temperatures. Improvements addressed this issue in the 1970's by the invention of the sandwich panel (U.S. Pat. No. 4,974,381). This improvement places a layer of insulation between a structural concrete inner layer and a non-structural concrete outer layer during the casting of the panel and then erecting this entire composite-like construction/unit as a panel.

Existing techniques to manufacture precast sandwich panels off site consist of pouring concrete into formwork containing reinforcing materials which moulds the concrete into the desired panel shape. Forms can be customized prior to each concrete pour with the insertion of window or door frames. Next a layer of insulation is placed on top of the first layer of concrete. Finally, a second layer of concrete is poured on top of the insulation containing reinforcing materials. A major design consideration is how to achieve a high shear stiffness and limit differential slip between the three layers to achieve optimal composite strength. To satisfy this requirement, connectors are inserted through the insulating layer to bond with the concrete in both layers. Whenever thermally conductive materials are utilized as connectors it generates thermal draws greatly reducing the panel's overall insulating properties.

In prior art, connecting systems are generally narrow or slender providing little bending stiffness. Simply increasing the amount inserted or dimension of materials does not increase the strength of the connection. As well, they are inserted perpendicular within the panel and are not well suited to stiffening the panel against longitudinal bending.

According to the new energy code, NEBC 2011, being implemented within the province of Manitoba as of December 2014, the effective R-value required for our climatic area is R-27. Additionally, the specific type of insulation used in our manufacturing of panels, poly isocyanurate, is being downgraded from R-7 to R 5.6.

Therefore, the primary objective of the present invention is to manufacture a sandwich panel with an improved effective R value while maintaining sufficient strength. To achieve this, the insulation layer must be increased in thickness and thermal leakage must be minimized and improved connectors are required to span the increased thickness of the insulation layer.

Another objective of this present invention is to provide a panel connector which achieves one or more of the following design features: be made of non-thermally conductive material, be of sufficient length to bridge the thick insulation layer, provide sufficient strength to the panel for lifting and reduced shearing, be readily accessible, and allow for design flexibility (panel width and length, differing insulation thicknesses and vestibulation placement).

SUMMARY OF THE INVENTION

According to one aspect of the invention there is provided a composite structural building panel comprising:

a first concrete layer and a second concrete layer in spaced apart relationship with one another;

an insulation layer spanning between the first concrete layer and the second concrete layer; and a plurality of shear connectors, each shear connector being supported individually to extend through a respective bore in the insulation layer between opposing first and second ends of the shear connector which are entirely embedded in the first and second concrete layers respectively;

at least some of the shear connectors comprising angled connectors which are oriented at an inclination to a normal axis of the insulating layer.

The connectors of the present invention are made of glass-fibre reinforced polymer (GFRP). This specialized material is resistant to corrosion, provides superior tensile strength than that of steel (2-3 times), is electromagnetically neutral and is an ideal insulator with significantly lower thermal conductivity than steel. Our connectors are 10 mm GFRP rods cut to the specified length (approximately 9-13", but not limited to this range) required for panel design. A washer is affixed to the rod providing a positive stop for the correct placement of the connector within the concrete wythes. This placement is necessary to achieve proper bonding between the connector and the wythes.

One of the unique features of this product is the placement of the connectors. The connectors are patterned in a modified Pratt truss-like design with some connectors placed at a 45 degree angle and the remaining connectors vertical. Connectors are placed vertically along the center across the panel. Angled connectors are placed on both sides of the center line pointing away from the center line. This pattern of vertical/angled connectors varies according to how much composite action is required in the panel design.

Using the design features of the connectors described herein, the resulting composite structural building panel is able to achieve one or more of the following benefits: i) improved effective R-value; ii) maintenance of customizable features (panel widths, lengths, vestibulation placements, wythe thicknesses); iii) no restrictions to pre-fab product widths or thicknesses; iv) optimized composite behaviour of the panel; v) efficient manufacturing process; vi) use of cost effective materials (commercially available connector where high cost); vii) low complexity design; viii) connectors which can be prepped as required; ix) improved quality control/assurance; x) manufactured inside under controlled environment; xi) customizable/flexible design; xii) change of width of panels is not dependent upon precut insulation or to suit type of connector; xiii) change of thickness of insulation can be easily accommodated using easy to prepare different lengths of rods instantly as required; xiv) placement of design features such as windows and doors can be easily accommodated; xv) length of panels can be varied; xvi) strength of the panel can be increased; xvii) shearing can be reduced as evident by span length achievable prior to sagging; xviii) significantly increased effective R value; and xix) no significant thermal draws are provided between the concrete layers.

Preferably the angled connectors are oriented at an inclination between 30 and 60 to a plane of the insulation layer.

The angled connectors may include: i) a plurality of first angled connectors which are parallel to one another and which extend from the first concrete layer to the second concrete layer at an inclination towards a first end of the panel, and ii) a plurality of second angled connectors which are parallel to one another and which extend from the first concrete layer to the second concrete layer at an inclination towards a second end of the panel which is opposite from the first end of the panel.

Preferably, the first angled connectors are supported in spaced apart relationship from one another in an array which is closer to the first end of the panel than the second end of the panel, and the second angled connectors are supported in spaced apart relationship from one another in an array which is closer to the second end of the panel than the first end of the panel.

Preferably some of the shear connectors also comprise normal connectors which are perpendicular to a plane of the insulation layer and which may be supported at a central location between opposing first and second ends of the panel. In this instance, the first angled connectors may be supported in spaced apart relation between the central location and the first end of the panel while the second angled connectors may be supported in spaced apart relation between the central location and the second end of the panel.

Preferably the insulation layer is continuous and uniform between opposing ends and opposing sides of the panel such that the bores which individually receive the shear connectors are the only openings in the insulation layer.

Preferably each shear connector comprises an elongate rod portion and a flange portion protruding radially outward from the rod portion in non-perpendicular relation with the rod portion such that the flange portion can be abutted in parallel relationship against a face of the insulation layer which is against one of the first and second concrete layers.

Preferably each shear connector consists solely of the rod portion which is uniform along the length thereof and the flange portion which is proximate to one end of the rod portion.

Preferably each shear connector comprises a uniform rod which defines the rod portion and an annular washer bonded about the uniform rod which defines the flange portion.

Preferably the shear connectors are individually supported within the insulating layer and are connected with one another solely through the layers of the panel.

Each angled shear connector may lie in a respective longitudinal plane which is parallel to the longitudinal planes of other ones of the angled shear connectors.

According to a second aspect of the present invention there is provided a method of forming a composite structural building panel, the method comprising:

providing a form;

pouring a first concrete layer into the form;

providing an insulation layer spanning the first concrete layer including a plurality of bores extending through the insulation layer between opposing faces of the insulation layer, wherein at least some of the bores are oriented at an inclination to a normal axis of the insulating layer;

providing a plurality of shear connectors which are elongate between opposing first and second ends respectively;

inserting the shear connectors individually into respective ones of the plurality of bores in the insulation layer such that:

i) the first ends of the shear connectors protrude from a first face of the insulation layer so as to be entirely embedded in the first concrete layer;

ii) the second ends of the shear connectors protrude from a second face of the insulation layer; and ii) at least some of the shear connectors comprise angled connectors which are oriented at an inclination to a normal axis of the insulating layer; and pouring a second concrete layer into the form such that the second ends of the shear connectors are entirely embedded in the second concrete layer.

When each shear connector comprises an elongate rod portion and a flange portion protruding radially outward from the rod portion in non-perpendicular relation with the rod portion, preferably the method includes inserting each angled shear connector such that the rod portion is at said inclination to the normal axis and such that the flange portion is abutted in parallel relationship against the second face of the insulation layer.

The method may further include supporting the angled shear connectors within the insulating layer such that the angled shear connectors are connected with one another solely through the insulating layer and the first and second concrete layers of the panel.

The method may also include supporting each angled shear connector to lie in a respective longitudinal plane which is parallel to the longitudinal planes of other ones of the angled shear connectors.

In a preferred embodiment, the shear connector are inserted into the insulating layer such that:

i) some of the shear connectors comprise normal connectors which are perpendicular to a plane of the insulation layer at a central location between opposing first and second ends of the panel; and ii) the angled connectors include a plurality of first angled connectors supported in spaced apart relation between the central location and the first end of the panel which are parallel to one another and which extend from the first concrete layer to the second concrete layer at an inclination towards the first end of the panel and a plurality of second angled connectors supported in spaced apart relation between the central location and the second end of the panel which are parallel to one another and which extend from the first concrete layer to the second concrete layer at an inclination towards the second end of the panel.

According to another aspect of the present invention there is provided a method of manufacturing a shear connector for use in a composite building panel comprising spaced apart first and second concrete layers and an insulation layer between the concrete layer, the method comprising:

providing an elongate rod;

cutting the elongate rod to a prescribed length which is greater than a thickness of the insulation layer and which is arranged to be entirely received within the first and second concrete layers at opposing ends thereof in a mounted position within the panel;

providing a flat annular washer;

fixing the washer about the elongate rod in proximity to one end of the rod in a non-perpendicular relationship with a longitudinal direction of the elongate rod.

In the illustrated embodiment, the elongate rod comprises a glass-fibre reinforced polymer rod, and the method includes fixing the washer to the elongate rod by bonding the washer to the glass-fibre reinforced polymer rod.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
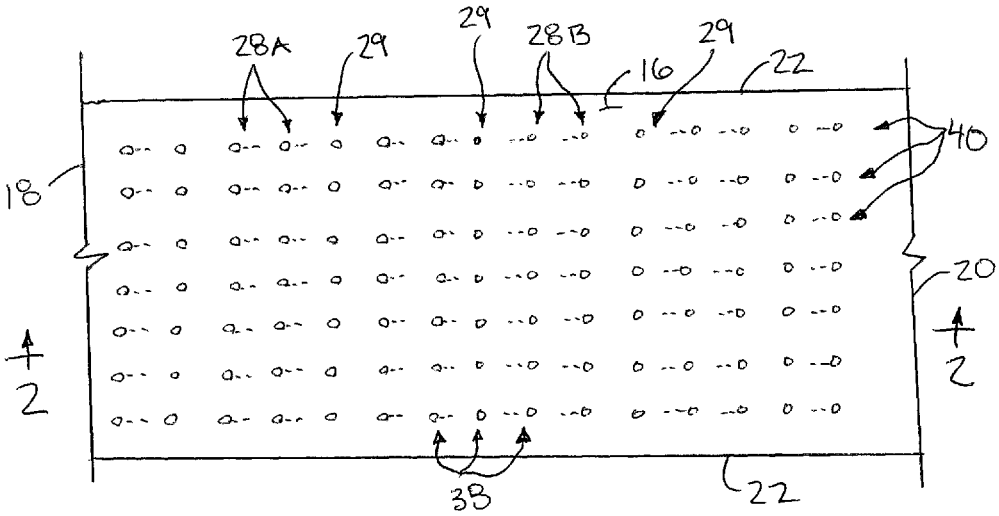
FIG. 1 is a plan view of the second face of the insulation layer of the composite structural building panel according to the present invention prior to the second concrete layer being applied showing the placement of the angled and normal shear connectors.
Figure 2:
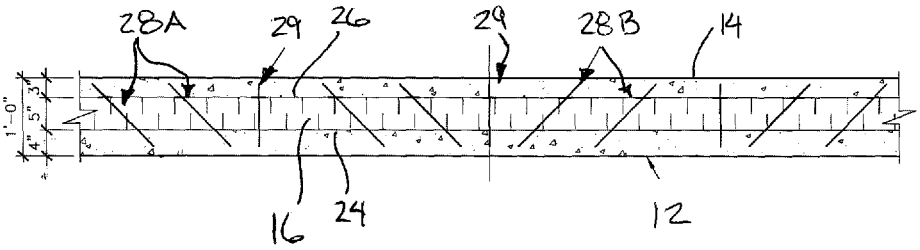
FIG. 2 is a sectional view of the completed panel along the line 2-2 of FIG. 1.
Figure 3:
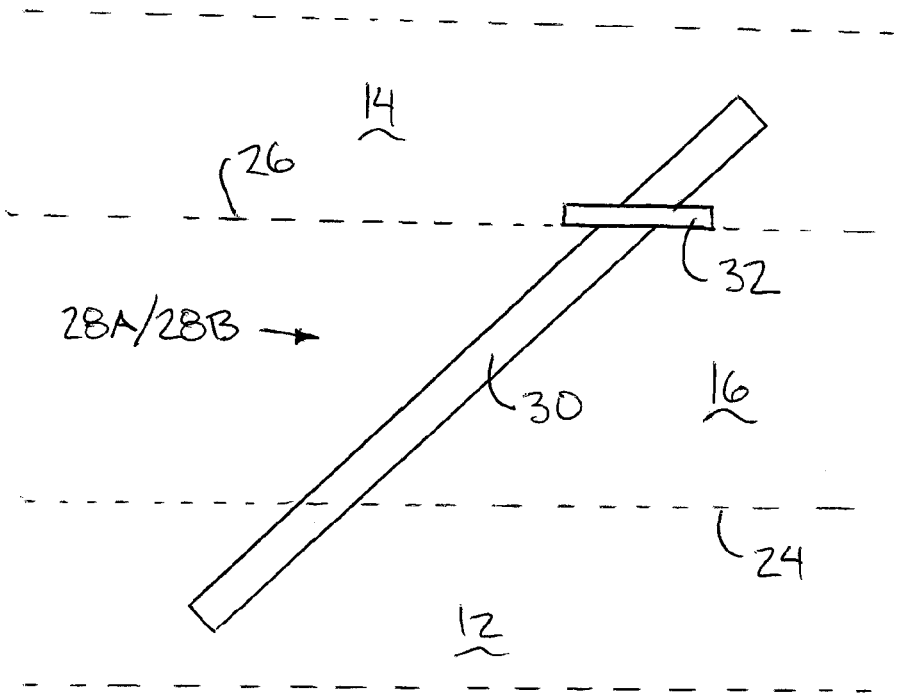
FIG. 3 is an enlarged side view of one of the angle shear connectors.
Figure 4:
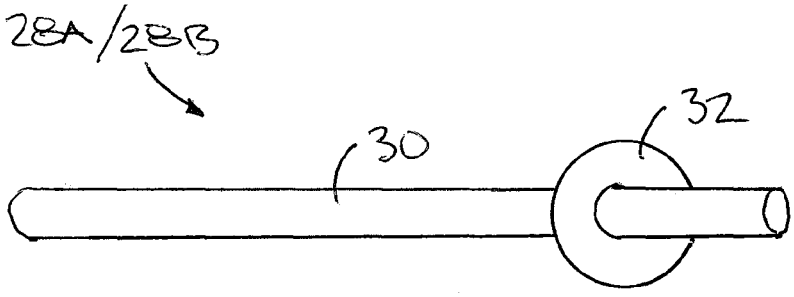
FIG. 4 is a top plan view of the angle shear connector of FIG. 3.

Referring to the accompanying figures there is illustrated a composite structural building panel generally indicated by reference numeral 10. The panel 10 is a precast concrete structure which is typically used as a vertical wall panel in the construction of various types of building structures.

The panel 10 generally includes a first concrete layer 12, a second concrete layer 14 parallel and spaced apart from the first concrete layer, and an insulation layer 16 occupying the space between the first and second concrete layers. The panel 10 may be of various shapes and sizes and may include openings therein to accommodate for windows and doors in the resulting building structure; however, in typical applications the panel spans longitudinally between a first end 18 (typically the top end) and a second end 20 (typically the bottom end) which is opposite from the top end 18, while spanning laterally between two opposing sides 22 in a generally rectangular form.

The insulation layer 16 is formed of a plurality of rigid insulation sheets which are abutted within one another in a single common plane such that the insulation layer is continuous and uniform between opposing ends 18, 20 and opposing sides 22 of the panel. The thickness of the panel between a first face 24 and a second face 26, which is parallel and opposite from the first face 24, is uniform throughout the panel.

The first concrete layer 12 spans in parallel abutment against the first face 24 of the insulation layer. The first concrete layer 12 defines a first outer surface of the resulting panel 10. The first concrete layer 12 is uniform in thickness between the insulation layer and the resulting first outer surface of the resulting panel.

Similarly, the second concrete layer 14 spans in parallel abutment against the second face 26 of the insulation layer. The second concrete layer 14 defines a second outer surface of the resulting panel 10. The second concrete layer 14 is uniform in thickness between the insulation layer and the resulting second outer surface of the resulting panel.

A plurality of shear connectors are provided which individually extend through respective bores in the insulation layer. The shear connectors include a plurality of first angled connectors 28A and second angled connectors 28B which are received through angled bores so as to be oriented at an inclination to a normal axis of the insulating layer and a plurality of normal connectors 29 which are received in normal bores which are perpendicular to a plane of the insulation layer in the installed positions thereof.

Each shear connector 28A, 28B, and 29 includes an elongate rod portion 30 and a flange portion 32 in proximity to one end of the rod portion.

The elongate rod portion 30 comprises a cut length of glass-fibre reinforced polymer which is uniform in cross-section and which extends longitudinally between a first end 34 and an opposing second end 36 of the shear connector. The rod portion is cut to a prescribed length from a round extruded member of stock glass-fibre reinforced polymer according to the selected thickness of the insulation layer and the overall wall panel. The length is selected to be greater than the thickness of the insulation layer such that the shear connector extends fully through the insulation layer to protrude beyond the first and second faces of the insulation at the first and second ends of the rod portion which are entirely embedded in the first and second concrete layers respectively.

The flange portion 32 comprises a flat, annular, metal washer which is mounted about the rod portion 30 and is fixed in a mounted position relative to the rod portion by bonding, for example using a curable epoxy or the like. The flange portion is supported to be closer to the second end of the rod portion, but spaced inwardly from the second end sufficiently so as to define an end portion of the rod which is entirely embedded within the second concrete layer in the assembled wall panel.

The flange portion 32 protrudes radially outward from the rod portion so as to be arranged to be abutted in parallel relationship against the second face 26 of the insulation layer 16 when the shear connector is inserted into its respective bore in the insulation layer during manufacturing.

In the instance of an angled connector 28A or 28B, the flange portion 32 is oriented to lie at a non-perpendicular inclination to the longitudinal direction of the rod portion, for example at an inclination of between 30 and 60 degrees. More preferably, the flange portion 32 is inclined relative to the rod portion by the same inclination as the angled bore relative to the first and second faces of the insulation layer which define a plane of the insulation layer. In the illustrated embodiment, the flange portion 32 is at an inclination of approximately 45 degrees to the longitudinal direction of the respective rod portion 30, similar to the inclination of the angled bores relative to the first and second faces of the insulation layer 16.

More particularly, the first angled connectors 28A are parallel to one another and extend from the first concrete layer to the second concrete layer at an inclination towards the first end 18 of the panel. The second angled connectors 28B are parallel to one another and extend from the first concrete layer to the second concrete layer at an inclination towards the second end of the panel.

In the instance of the normal connectors 29, the flange portion 32 lies perpendicularly to the longitudinal direction of the respective rod portion. In either instance of angled or normal connectors, the flange portions 32 thus lies in parallel abutment with the second face of the insulation layer when installed.

According to the illustrated embodiment, the normal and angled shear connectors are installed in an array of laterally extending rows 38 and longitudinally extending columns 40 in a modified Pratt truss-like pattern. The shear connectors within each laterally extending row are evenly spaced apart in the lateral direction between the sides 22 of the panel. Similarly, within each column, the shear connectors are evenly spaced apart from one another in the longitudinal direction.

Turning now more particularly to the illustrated pattern of shear connectors, the pattern includes one row of normal connectors 29 installed at a central location in the insulation layer which is generally centered between the first and second ends 18 and 20 of the panel such that the row is parallel to the first and second ends 18 and 20.

Each normal connector 29 of the central one of the rows 38 further belongs to a respective column of shear connectors extending longitudinally between the first and second ends. All of the shear connectors within a common column lie in a common longitudinal plane which is perpendicular to the first and second faces of the insulation layer and which is parallel to the other longitudinal planes so as to extend longitudinally between the first and second ends of the panel.

The first angled connectors 28A are all spaced apart from one another in the rows 38 between the central row of normal connectors 29 at the central location and the first end 18 of the panel such that the first angled connectors are located in a first array which is closer to the first end of the panel than the second end of the panel.

Similarly, the second angled connectors 28B are all spaced apart from one another in the rows 38 between the central row of normal connectors 29 at the central location and the second end 20 of the panel such that the second angled connectors are located in a second array which is closer to the second end of the panel than the first end of the panel.

Some of the rows 38 of shear connectors at intermediate locations between the central row and each of the first and second ends of the panel may also comprise a row of normal connectors 29. Accordingly, within each column of shear connectors from the central row, towards each of two opposing ends of the panel, the connectors typically alternate in a pattern of one or more consecutive angled connectors, followed by one or more normal connectors, in a repeating manner along the length of the panel. In the illustrated embodiment, two rows of angled connectors 28A or 28B are provided between each row of normal connectors 29 in the longitudinal direction between the ends 18 and 20 of the panel.

The composite structural building panel is typically formed in a horizontally extending form which initially permits the first concrete layer to be poured therein. Rigid sheets of insulation are then supported on the uncured first concrete layer to form a uniform layer which is uniform and uninterrupted by any openings other than the bores which individually receive respective ones of the shear connectors therein.

The shear connectors are then inserted into the already formed bores in the panels which dictate the pattern of normal and angled connectors installed in the resulting wall panel. The shear connectors are inserted such that the first ends of the shear connectors protrude from a first face of the insulation layer down into the first concrete layer to be entirely embedded in the first concrete layer. The second ends remain protruding upward beyond the second face of the insulation layer by an amount dictating by the flange portions 32 which abut the second face of the insulation. The second concrete layer can then be poured into the form such that the second ends of the shear connectors are entirely embedded in the second concrete layer.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A composite structural building panel comprising:

a first concrete layer and a second concrete layer in spaced apart relationship with one another;

an insulation layer spanning between the first concrete layer and the second concrete layer; and a plurality of shear connectors, each shear connector being supported relative to the concrete layers and the insulation layer independently of other ones of the shear connectors so as to individually extend through a respective bore in the insulation layer between opposing first and second ends of the shear connector which are entirely embedded in the first and second concrete layers respectively such that each shear connector is connected to other ones of the shear connectors solely by the concrete layers and the insulation layer extending between the shear connectors;

at least some of the shear connectors comprising angled connectors which are oriented at an inclination to a normal axis of the insulating layer.

2. The panel according to claim 1 wherein the angled connectors are oriented at an inclination between 30 degrees and 60 degrees to a plane of the insulation layer.

3. The panel according to claim 1 wherein the angled connectors include a plurality of first angled connectors which are parallel to one another and which extend from the first concrete layer to the second concrete layer at an inclination towards a first end of the panel and a plurality of second angled connectors which are parallel to one another and which extend from the first concrete layer to the second concrete layer at an inclination towards a second end of the panel which is opposite from the first end of the panel.

4. The panel according to claim 3 wherein the first angled connectors are supported in spaced apart relationship from one another in an array which is closer to the first end of the panel than the second end of the panel.

5. The panel according to claim 3 wherein the second angled connectors are supported in spaced apart relationship from one another in an array which is closer to the second end of the panel than the first end of the panel.

6. The panel according to claim 1 wherein some of the shear connectors comprise normal connectors which are perpendicular to a plane of the insulation layer.

7. The panel according to claim 6 wherein a plurality of the normal connectors are supported at a central location between opposing first and second ends of the panel and wherein the angled connectors include a plurality of first angled connectors supported in spaced apart relation between the central location and the first end of the panel which are parallel to one another and which extend from the first concrete layer to the second concrete layer at an inclination towards the first end of the panel and a plurality of second angled connectors supported in spaced apart relation between the central location and the second end of the panel which are parallel to one another and which extend from the first concrete layer to the second concrete layer at an inclination towards the second end of the panel.

8. The panel according to claim 1 wherein the insulation layer is continuous and uniform between opposing ends and opposing sides of the panel such that the bores which individually receive the shear connectors are the only openings in the insulation layer.

9. The panel according to claim 1 wherein each shear connector comprises an elongate rod portion and a flange portion protruding radially outward from the rod portion in non-perpendicular relation with the rod portion, the flange portion being abutted in parallel relationship against a face of the insulation layer which is against one of the first and second concrete layers.

10. The panel according to claim 9 wherein each shear connector consists solely of the rod portion which is uniform along the length thereof and the flange portion which is proximate to one end of the rod portion.

11. The panel according to claim 9 wherein each shear connector comprises a uniform rod which defines the rod portion and an annular washer bonded about the uniform rod which defines the flange portion.

12. The panel according to claim 1 wherein each angled shear connector lies in a respective longitudinal plane which is parallel to the longitudinal planes of other ones of the angled shear connectors.

13. A composite structural building panel comprising:

a first concrete layer and a second concrete layer in spaced apart relationship with one another;

an insulation layer spanning between the first concrete layer and the second concrete layer; and a plurality of shear connectors, each shear connector being supported individually to extend through a respective bore in the insulation layer between opposing first and second ends of the shear connector which are entirely embedded in the first and second concrete layers respectively;

at least some of the shear connectors comprising angled connectors which are oriented at an inclination to a normal axis of the insulating layer and which are connected to other ones of the shear connectors solely by the concrete layers and the insulation layer extending between the shear connectors;

each angled shear connector consisting solely of an elongate rod portion oriented at an inclination to a normal axis of the insulating layer and a flange portion joined to the rod portion in non-perpendicular relation with the rod portion so as to be abutted in parallel relationship against a face of the insulation layer which is against one of the first and second concrete layers.

14. The panel according to claim 13 wherein the flange portion is adhesively bonded to the rod portion.

15. A composite structural building panel comprising:

a first concrete layer and a second concrete layer in spaced apart relationship with one another;

an insulation layer spanning between the first concrete layer and the second concrete layer; and a plurality of shear connectors, each shear connector being supported individually to extend through a respective bore in the insulation layer between opposing first and second ends of the shear connector which are entirely embedded in the first and second concrete layers respectively;

at least some of the shear connectors comprising angled connectors which are oriented at an inclination to a normal axis of the insulating layer and which are connected to other ones of the shear connectors solely by the concrete layers and the insulation layer extending between the shear connectors;

each angled shear connector consisting solely of an elongate rod portion consisting of glass-fibre reinforced polymer rod which has been cut to length and which is oriented at an inclination to a normal axis of the insulating layer and a flange portion adhesively bonded to the rod portion in non-perpendicular relation with the rod portion so as to be abutted in parallel relationship against a face of the insulation layer which is against one of the first and second concrete layers.

* * * * *